United States Patent [19]

Slattery

[11] Patent Number: 4,637,800

[45] Date of Patent: Jan. 20, 1987

[54] SHALLOW WATER TILT MECHANISM FOR OUTBOARD MOTORS

[75] Inventor: Gordon C. Slattery, Omro, Wis.

[73] Assignee: Brunswick Corporation, Skokie, Ill.

[21] Appl. No.: 765,016

[22] Filed: Aug. 9, 1985

[51] Int. Cl.[4] ..... B63H 5/06

[52] U.S. Cl. ..... 440/55; 440/63

[58] Field of Search ..... 440/55, 61, 63; 248/640–643; 74/569

[56] References Cited

U.S. PATENT DOCUMENTS

| | | | |
|---|---|---|---|
| 3,576,173 | 4/1971 | Ginnow | 440/55 |
| 3,785,329 | 1/1974 | Shimanckas | 440/55 |
| 3,835,807 | 9/1974 | Kueny | 440/55 |

*Primary Examiner*—Galen L. Barefoot
*Assistant Examiner*—Jesûs D. Sotelo
*Attorney, Agent, or Firm*—O. T. Sessions

[57] ABSTRACT

An outboard motor (10) is supported on a boat by a swivel bracket (12) mounted for tilting movement on a transom bracket (11). A shallow water tilt mechanism is provided by a shallow drive bracket (29) controlled by a lever (30) mounted on the swivel bracket (12). The lever (30) is linked to the shallow drive bracket (29) by a double acting torsion spring (38) which allows the operator to set the lever (30) for the desired position of the shallow drive bracket (29). Subsequent tilting movement of the swivel bracket (12) allows the shallow drive bracket to assume the preselected position.

5 Claims, 6 Drawing Figures

SHALLOW WATER TILT MECHANISM FOR OUTBOARD MOTORS

DESCRIPTION

1. Technical Field

This invention relates to outboard motors and particularly to a tilt mechanism providing a tilt position for operating in shallow water.

2. Background Art

The drive member of an outboard motor is ordinarily tiltable relative to the transom of the boat on which it is mounted. An adjustment is usually provided to allow the operator to establish an operating trim angle, that is, the angle between the outboard propulsion unit and the boat transom. In manually tiltable outboard motors, the operating trim angle adjustment is ordinarily provided by a trim pin whose position can be established by the operator for normal operation. Occasionally it is desirable to be able to operate the outboard motor at a higher trim angle, without requiring repositioning of a trim pin.

U.S. Pat. No. 3,576,173 to Ginnow discloses a mechanism utilizing a bracket pivoted to the outboard propulsion unit to allow temporary positioning of the propulsion unit at a greater trim angle than that set by the trim pin.

DISCLOSURE OF INVENTION

It is an object of the present invention to provide a shallow water tilt mechanism which is highly reliable, simple to operate, and readily manufactured.

The present invention provides a tilt mechanism for a marine propulsion device which has a transom bracket for attachment to the boat and a swivel bracket pivotally supported on the transom bracket to allow tilting movement about a generally horizontal tilt axis. The tilt mechanism includes a shallow drive bracket pivotally supported on the swivel bracket for rotation about a generally horizontal support axis, between a retracted position and a shallow drive position. A shallow drive bracket is arranged to engage the transom bracket in the shallow drive position to support the swivel bracket in an elevated position. An operating lever is pivotally mounted on the swivel bracket for rotation about the support axis and a double acting spring is used to bias the shallow drive bracket toward a fixed angular position relative to the operating lever.

Preferably the tilt mechanism includes an over-center arrangement to hold the operating lever in either a first position corresponding with the shallow drive position or a second position corresponding with the retracted position. The operating lever can include a cam means engaging a reverse hook to disengage the reverse hook when the lever is moved to the shallow drive position.

BEST MODE FOR CARRYING OUT THE INVENTION

Figure 1:
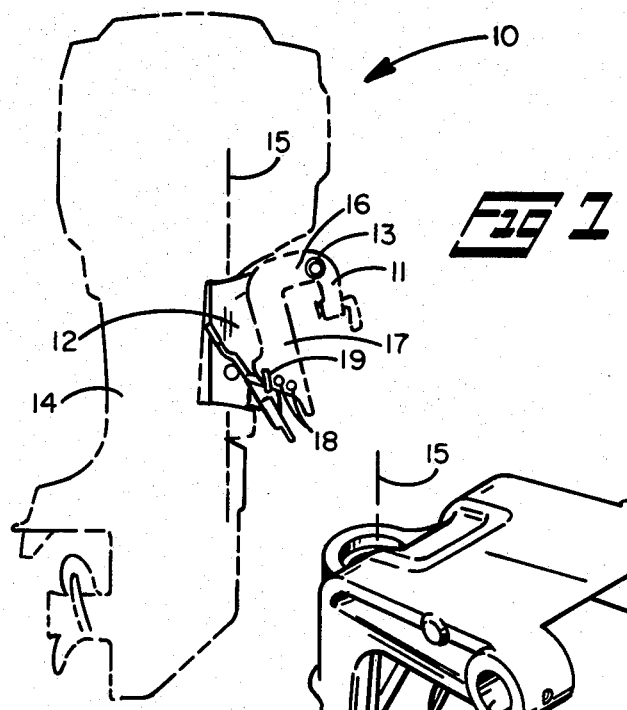
FIG. 1 is a side view of an outboard motor incorporating the invention.
Figure 2:
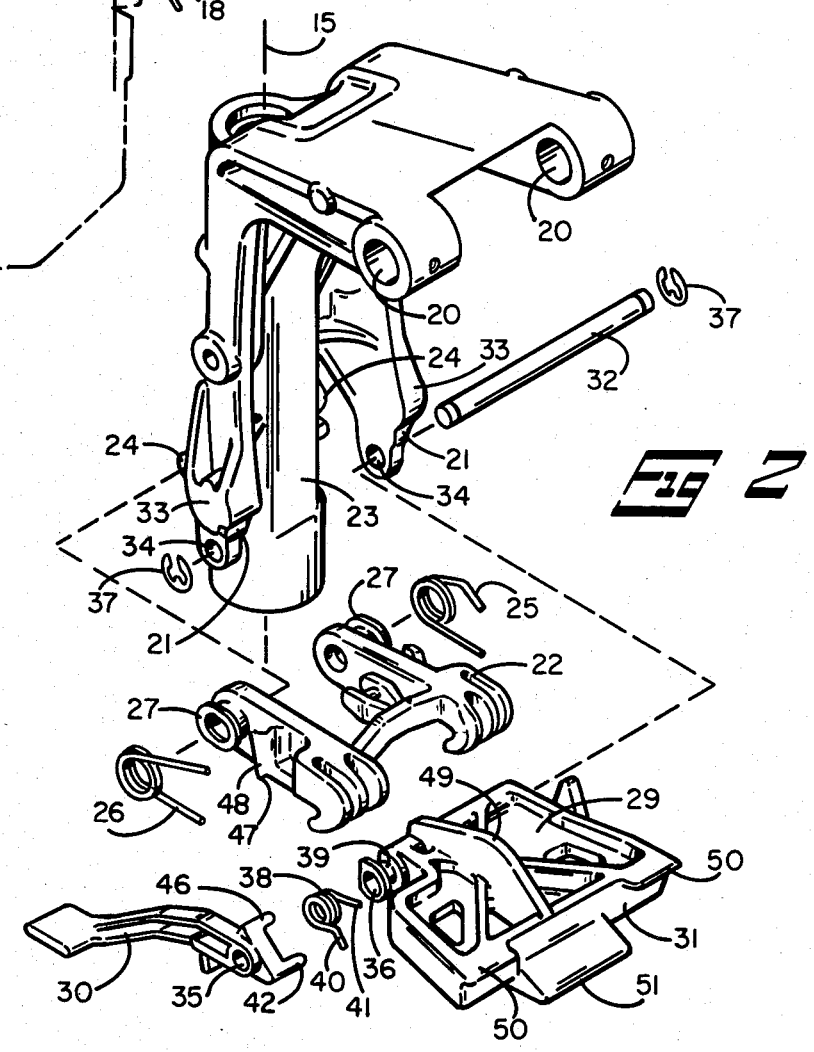
FIG. 2 is an exploded view of the mechanism of the invention.

Referring to the drawings an outboard motor 10 for mounting on the transom of a boat is illustrated. The outboard motor 10 includes a transom bracket 11 for clamping to the transom of the boat and a swivel bracket 12 pivotally attached to the transom bracket 11 by a pivot tube 13 to allow tilting movement of the propulsion unit 14 of the outboard motor 10 about the pivot axis formed by the pivot tube 13. The propulsion unit 14 is pivotally mounted about a generally vertical steering axis 15 formed in the swivel bracket 12 to allow steering movement in a conventional manner.

The transom bracket 11 includes laterally spaced port and starboard clamping members 16, only one illustrated, connected by the pivot tube 13. The clamping members 16 each include a rearwardly extending trim adjustment projection 17 provided with a plurality of corresponding holes 18 located at a fixed radius from the pivot tube 13. The corresponding holes 18 are transversally aligned to allow the insertion of a trim adjustment pin 19 through corresponding holes 18 to permit the operator to establish the operating trim angle for the propulsion unit 14. The swivel bracket 12 includes transverse holes 20 through the forward upper portion of the bracket 12 to support the swivel bracket 12 on the pivot tube 13 between the clamping members 16. Abutments 21, formed at the lower end of the swivel bracket 12, rest against the trim pin 19 immediately adjacent the clamping members 16 to establish the operating trim angle of the propulsion unit 14.

A reverse hook 22 is mounted on the swivel bracket 12 to latch the swivel bracket 12 to the transom bracket 11 to prevent upward tilting of the propulsion unit 14 when operating in a reverse thrust mode. The reverse hook 22 is pivotally supported on the swivel tube portion 23 of the swivel bracket 12 near the lower end of the swivel tube 23. Studs 24 formed on opposite sides of the swivel tube 23 provide a horizontal axis for the reverse hook 22. Torsion springs 25 and 26 are mounted about tubular projections 27 formed on the sides of the reverse hook 22 around the studs 24. The torsion springs 25 and 26 bias the reverse hook 22 in a downward direction to engage the trim pin 19. Thus in the normal reverse operating position shown in FIG. 3, the reverse hook 22 will engage the trim pin 19 to latch the swivel bracket 12 to the transom bracket 11 to prevent upward tilting of the propulsion unit 14. Stops 28 formed on the opposite sides of the swivel tube 23 limit the downward rotation of the reverse hook 22. The reverse hook 22 will normally be connected by a linkage, not illustrated, to the gear shift mechanism of the outboard motor 10 to disengage the reverse hook 22 from the trim pin 19 when the motor is operated in forward gear.

A shallow drive mechanism is provided to allow operation of the outboard propulsion unit 14 at an elevated angle without the necessity of changing the position of the trim pin 19. The shallow drive mechanism includes a shallow drive bracket 20 pivotally attached to the swivel bracket 12. An operating lever 30 is provided to give the operator control of the mechanism. In the shallow drive position, FIGS. 5 and 6, the free end 31 of the shallow drive bracket 29 engages the trim pin 19 to support the propulsion unit 14 at the elevated angle.

The operating lever 30 and shallow drive bracket 29 are both pivotally mounted on a pin 32 supported at the lower ends of the two wings 33 of the swivel bracket 12. The pin 32 extends through the holes 34 formed through the wings 33, the hole 35 through the operating lever 30, and the hole 36 through the shallow drive bracket 29 and is held in place by clips 37 attached to the ends of the pin 32. A double acting torsion spring 38 is mounted on the tubular extension 39 formed on the shallow drive bracket 29. The double acting torsion spring 38 is coiled around the tubular extension 39 of the shallow drive bracket and has arms 40 and 41 formed by the ends of the coil. The two arms 40 and 41 of the torsion spring 38 are biased toward each other and engage the opposite sides of the projection 42 formed on the operating lever 30 and the projection 43 formed on the shallow drive bracket 29. The effect of the double acting torsion spring 38 is to bias the shallow drive bracket 29 toward a fixed angular relationship to the operating lever 30, that is the relationship shown in both FIGS. 3 and 5, while allowing the lever 30 to be moved when movement of the shallow drive bracket 29 is restrained.

Figure 3:
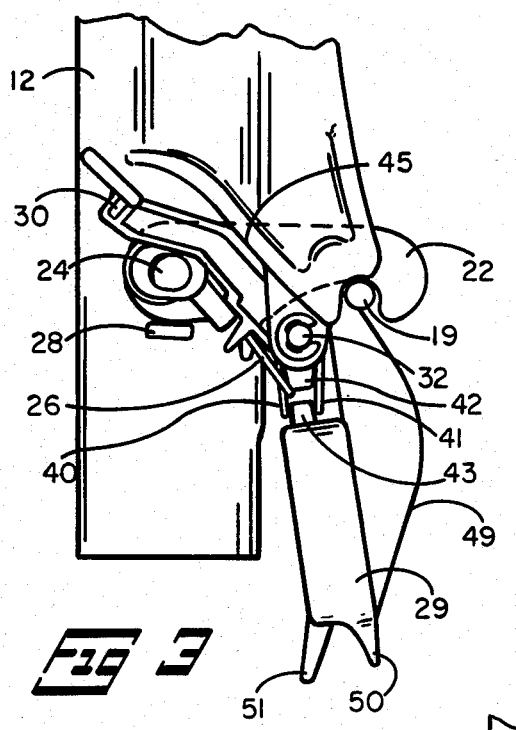
FIGS. 3–6 are partial side views of the outboard motor illustrating the mechanism of the invention in several different positions.

One arm 44 of the torsion spring 26 which biases the reverse hook 22 engages the projection 42 on the operating lever 30. The spring arm 44 is biased toward the pin 32 supporting the operating lever 30 and provides an over center action on the operating lever 30. Thus when the operating lever 30 is in the normal operating position as shown in FIGS. 3 and 6, the spring 26 will bias the lever 30 in a clockwise direction against a stop 45 formed by the wing of the swivel bracket 12. When the operating lever 30 is in the shallow drive position shown in FIGS. 4 and 5, the spring arm 44 will bias the lever 30 in a counter clockwise direction so the cam element 46 formed on the operating lever 30 rests against a stop 47 formed on the reverse hook 22. The cam element 46 on the operating lever 30 acts with a cam surface 48 on the reverse hook 22 to lift the reverse hook 22 out of engagement with the trim pin 19 when the actuating lever 30 is in the shallow drive position.

Operation

Figure 4:
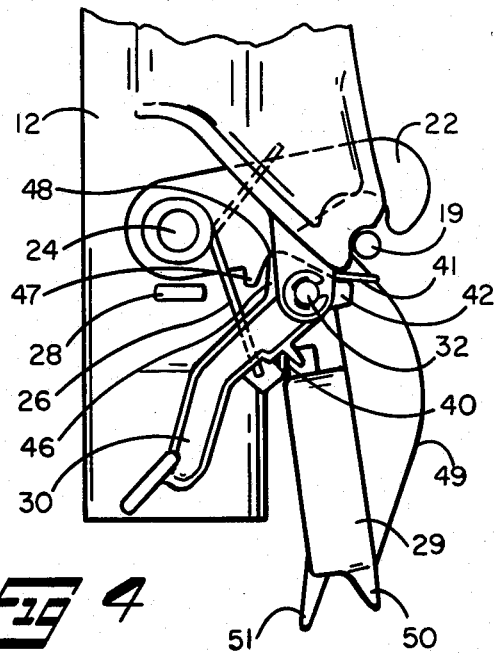

The invention provides a simple way to change the trim position of the outboard propulsion unit 14 between the normal operating trim position and an elevated shallow drive position. FIG. 3 shows the unit 14 in the normal trim position, with the abutments 21 on the swivel bracket 12 resting on the trim pin 19 mounted through the transom bracket 11. To raise the propulsion unit 14 and support it in the shallow drive position, the operator would first move the operating lever 30 to the shallow drive position as shown in FIG. 4. This action would raise the reverse hook 22 to disengage it from the trim pin 19 and bias the shallow drive bracket 29 in a counter clockwise direction so tht the cam surface 49 formed on the forward side of the shallow drive bracket 29 would be biased against the trim pin 19.

Figure 5:
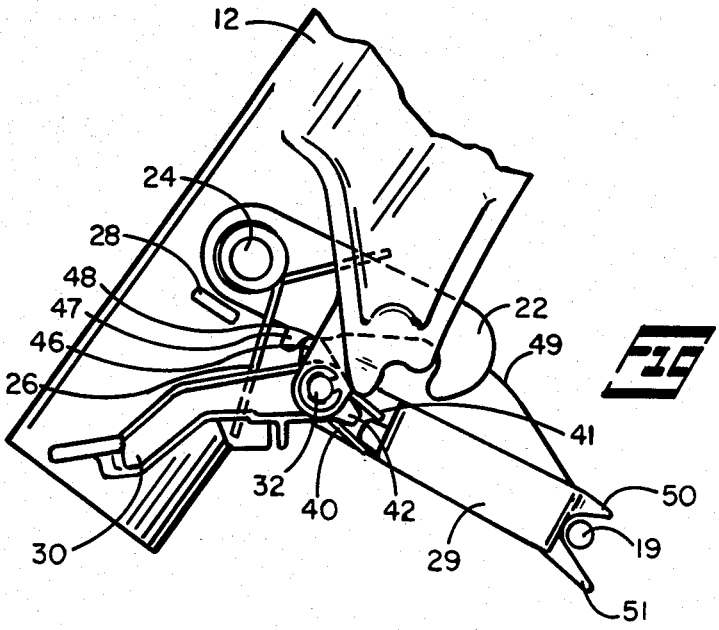
Figure 6:
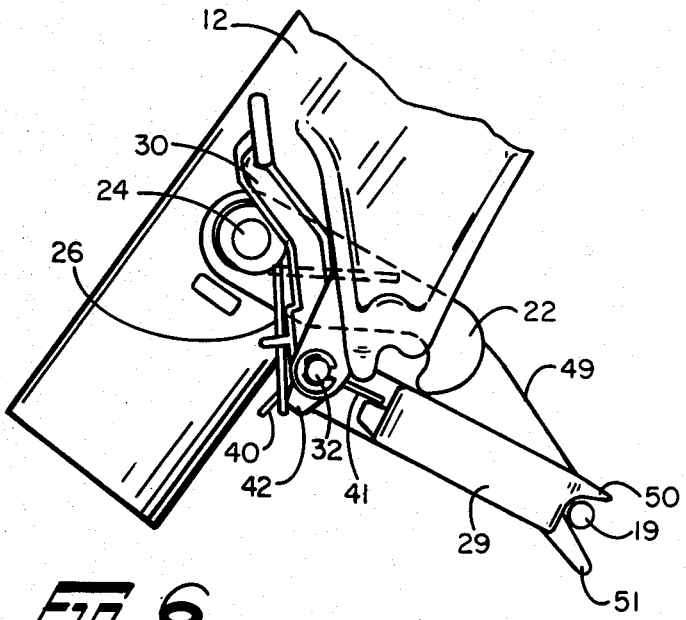

Next, the operator would manually rotate the propulsion unit 14 to the elevated shallow drive position shown in FIG. 5. As the propulsion unit 14 is rotated the cam surface 49 on the shallow drive bracket 29 would ride against the trim pin 19 until the shallow drive position is reached. As the shallow drive position is reached, the trim pin 19 would ride over the end of the projections 50 formed at the free end of the shallow drive bracket 29 and fall into the groove formed by the projections 50 and 51 at the end of the bracket 29. The operator could then release the outboard propulsion unit 14 and the unit 14 would be supported against the trim pin 19 by the shallow drive bracket 29.

The operator can lower the propulsion unit 14 from the shallow water drive position by first moving the operating lever 30 to the normal operating position as shown in FIG. 6. In this position the reverse hook 22 is returned to its normal position and the shallow drive bracket 29 is biased by the double acting torsion spring 38 to rotate in a clockwise direction. The operator may then lift the propulsion unit 14 slightly to disengage the shallow drive bracket 29 from the trim pin 19. The shallow drive bracket 29 will then rotate to its normal position in relationship to the operating lever 30 and the propulsion unit 14 may be lowered to the normal operating trim position shown in FIG. 3.

I claim:

1. A tilt mechanism for a marine propulsion device comprising:

(A) a transom bracket for attachment to a boat;

(B) a swivel bracket pivotally supported on said transom bracket for tilting movement about a generally horizontal tilt axis;

(C) a shallow drive bracket pivotally supported on said swivel bracket for rotation about a generally horizontal support axis between a retracted position and a shallow drive position, said shallow drive bracket engaging said transom bracket in said shallow drive position to support said swivel bracket;

(D) an operating lever pivotally mounted on said swivel bracket for rotation about said support axis;

(E) a double acting spring means for biasing said shallow drive bracket toward a fixed angular position relative to said operating lever; and (F) an over-center means to hold said operating lever in either a first position corresponding with said shallow drive position or a second position corresponding with said retracted position.

2. The tilt mechanism defined in claim 1 further comprising a reverse hook pivotally mounted on said swivel bracket and a reverse hook spring means biasing said hook toward a position engaging said transom bracket, said operating lever including a cam means engaging said reverse hook to disengage said reverse hook when said lever is moved to said first position.

3. The tilt mechanism defined in claim 2 wherein said reverse hook spring means includes a torsion spring mounted on the pivot axis of said reverse hook, said torsion spring having a first arm engaging said reverse hook, and said over-center means includes a second arm of said torsion spring engaging said lever.

4. The tilt mechanism defined in claim 3 wherein said double acting spring means consists of a double acting torsional spring mounted about said support axis, said double acting spring having two arms extending radially outward from said support axis, and said support bracket and said lever each include surfaces for engaging both of said double acting spring arms.

5. A tilt mechanism for a marine propulsion device comprising:

(A) a transom bracket for attachment to a boat;

(B) a swivel bracket pivotally supported on said transom bracket for tilting movement about a generally horizontal tilt axis;

(C) a shallow drive bracket pivotally supported on said swivel bracket for rotation about a generally horizontal support axis between a retracted position and a shallow drive position, said shallow drive bracket engaging said transom bracket in said shallow drive position to support said swivel bracket;

(D) an operating lever pivotally mounted on said swivel bracket for rotation about said support axis; and (E) a double acting spring means for biasing said shallow drive bracket toward a fixed angular position relative to said operating lever.

* * * * *